US005848635A

United States Patent [19]

Aoi et al.

[11] Patent Number: 5,848,635

[45] Date of Patent: Dec. 15, 1998

[54] CONTINUOUS CASTING DEVICE

[75] Inventors: Tatsufumi Aoi; Noriyuki Kawada; Hiroshi Nakajima; Kenichi Unoki; Motomi Nakashima; Youichi Wakiyama, all of Hiroshima, Japan

[73] Assignee: Mitsubishi Jukogyo Kabushiki Kaisha, Tokyo, Japan

[21] Appl. No.: 686,984

[22] Filed: Jul. 25, 1996

[30] Foreign Application Priority Data

Aug. 1, 1995 [JP] Japan ..... 7-196318
Jun. 14, 1996 [JP] Japan ..... 8-153688

[51] Int. Cl.[6] ..... B22D 27/02; B22D 11/06

[52] U.S. Cl. ..... 164/467; 164/480; 164/428; 164/503

[58] Field of Search ..... 164/466, 467, 164/502, 480, 428, 146

[56] References Cited

U.S. PATENT DOCUMENTS 4,887,662 12/1989 Tanaka et al. .
5,052,467 10/1991 Tanaka et al. .
5,103,895 4/1992 Furuya et al. .
5,191,927 3/1993 Terado et al. .
5,201,362 4/1993 Yamagami et al. .
5,368,088 11/1994 Furuya et al. .
5,390,726 2/1995 Fukuda et al. .
5,400,849 3/1995 Sasaki et al. .
5,439,046 8/1995 Miyazawa ..... 164/467
5,469,909 11/1995 Sasaki et al. .
5,487,421 1/1996 Gerber ..... 164/467
5,495,886 3/1996 Kolesnichenke ..... 164/467

FOREIGN PATENT DOCUMENTS 3-5048 1/1991 Japan ..... 164/466

*Primary Examiner*—Patrick Ryan
*Assistant Examiner*—I.-H. Lin
*Attorney, Agent, or Firm*—Wenderoth, Lind & Ponack, L.L.P.

[57] ABSTRACT

A continuous casting device includes a pair of cooling rolls (1, 2) that rotate in opposite directions to each other. A pair of side weirs (11) have inner surfaces (11*a*) that covers the end surfaces (1*a*, 2*a*) of the cooling rolls (1, 2) and circular surfaces (12*b*) that covers the peripheral surfaces (1*b*, 2*b*) of the cooling rolls (1, 2). At least one of the side weirs (11) is movable in an axial direction of the cooling rolls (1, 2). The continuous casting device also includes electromagnets for forming a magnetic flux in a direction parallel with a contact surface of the side weirs (11) with the molten metal (4) the contact surface extending along the peripheral surfaces (1*b*, 2*b*) of the cooling rolls (1, 2) at the portions opposite to the peripheral surfaces (1*b*, 2*b*) of the cooling rolls (1, 2) of the side weirs (11).

20 Claims, 12 Drawing Sheets

TWO DEVICES SEPARATELY CONNECTED

ONE DEVICE CONNECTED IN PARALLEL

ONE DEVICE CONNECTED IN SERIES

ONE DEVICE CONNECTED IN PARALLEL

⊙ INDICATIVE OF STATE IN WHICH CURRENT FLOWS DIRECTED TOWARD THE FRONT OF PAPER SURFACE

⊗ INDICATIVE OF STATE IN WHICH CURRENT FLOWS DIRECTED TOWARD THE BACK OF PAPER SURFACE

CONTINUOUS CASTING DEVICE

BACKGROUND OF THE INVENTION

1. Field of the Invention

The present invention relates to a continuous casting device in which a molten metal is supplied between two rolls that rotate to manufacture a band-like plate continuously.

2. Description of the Related Art

FIGS. 20 and 21 show one example of a conventional continuous casting device in which a molten metal is supplied between two rolls that rotate to manufacture a band-like plate continuously. FIG. 20 is a schematic front view showing the conventional continuous casting device whereas FIG. 21 is a plan view thereof.

As shown in FIGS. 20 and 21, the continuous casting device is mainly made up of a pair of rolls 1 and 2 which are disposed horizontally in parallel with each other, and a pair of weirs 5 for accumulating a molten metal 4 (hereinafter the metal is referred to as a molten steel as an example) supplied from a supply nozzle 3 in a valley-shaped space which is defined by those cooling rolls 1 and 2. The weirs 5 are located in such a state as to cover an end surface of one cooling roll 1 or 2 and to cover the peripheral surface of the other cooling roll 2 or 1. Each of the weirs 5 is equipped with a heater 6 for heating and controlling the temperature. The cooling rolls 1 and 2 are driven by drive means (not shown) in such a manner that the respective opposed outer peripheral surfaces of those cooling rolls 1 and 2 rotate downward.

In the continuous casting device thus organized, when the cooling rolls 1 and 2 are activated, and the molten steel 4 is supplied from the nozzle 3 to the valley-shaped space defined between the cooling rolls 1 and 2, then the molten steel 4 is solidified on the outer peripheral surface of the cooling rolls 1 and 2 to thereby generate a solidified shell. The solidified shell is guided downward with the rotation of the cooling rolls 1 and 2 and is then pressed by the cooling rolls 1 and 2 on the close contact portion thereof, to thereby form a single band-like plate (steel plate) 4*a*. The band-like plate 4*a* is extruded continuously. With a change in the position of at least one weir 5 in an axial direction of the cooling rolls 1 and 2, the width of the band-like plate 4*a* to be cast can be changed. The continuous casting device thus organized is disclosed, for examples in Japanese Patent Unexamined Publication No. Sho 63-180348.

By the way, in the above-mentioned continuous casting device, a leakage of the molten steel 4 from the ends of the cooling rolls 1 and 2 is merely mechanically restrained by pushing the arc-shaped surface of the weirs 5 against the peripheral surfaces of the cooling rolls 1 and 2. In other words, the weirs 5 and the molten steel 4 are in contact with each other. Because the solidification of the molten steel 4 is developed in particular in the vicinity of the portion where the peripheral surfaces of the cooling rolls 1, 2 and the weirs 6 are in contact with the molten steel 4, a defect occurs on the end portions of the casted plate. Also, a problem arises in that the rolls are deformed by the abrasion of the roll surface, and the sealing performance of the molten steel 4 is lowered by the abrasion of the weir material.

Another type of system for sealing the ends of the cooling rolls 1 and 2 is a system for holding the molten steel using an a.c. magnetic field, as disclosed in Japanese Patent Unexamined Publication No. Hei 6-99251, Japanese Patent Unexamined Publication No. Hei 3-35851, etc.

The system disclosed in Japanese Patent Unexamined Publication No. Hei 6-99251 is made up of a pair of side weirs disposed between a pair of cooling rolls and having a wall portion made up of electrically conductive segments, cores of a ferromagnetic substance disposed above and below those side weirs, induction coils wound around the cores, and so on. Upon applying an a.c. current to the induction coils, an a.c. magnetic field is developed vertically developed in the induction coils. The magnetic field makes an induction current flow in the electrically conductive segments to thereby develop a magnetic field due to the induction current. As a result, a magnetic flux is concentrated between the molten steel which is disposed between the cool rolls and the induction segments as a composite magnetic field consisting of the vertical magnetic field and the magnetic field caused by the induction current. Hence, the strong magnetic field and the induction current that flows in the molten steel allows the Lorentz's force to be exerted on the molten steel in a direction of going away from the induction segments, to thereby restrain the leakage of the molten steel from the ends of the cooling rolls.

However, the system disclosed in Japanese Patent Unexamined Publication No. Hei 6-99251 requires that the induction current by allowed to flow in the induction segments except that the current flows into the induction coils, to thereby increase the loss of Joule's heat. Also, because the system has a structure in which the leakage of the molten steel is prevented by the overall surfaces of the weirs, excessive electric power is consumed in order to seal a portion other than the portion where the cooling rolls are in contact with the weirs, which is the most important portion to seal.

The system disclosed in Japanese Patent Unexamined Publication No. Hei 3-35851 has weirs which are situated between a pair of rolls and made up of a circular conductor, a refractory material and a heater for heating the weirs. In the weirs, upon applying an a.c. current to the electric conductor, an a.c. magnetic field is so developed as to surround the electric conductor. Hence, the magnetic field and the induction current that flows in the molten steel allow the Lorentz's force to be exerted on the molten steel in a direction going away from the electric conductor to thereby restrain the leakage of the molten steel from the ends of the cooling roll ends.

However, in the system disclosed in Japanese Patent Unexamined Publication No. Hei 3-35851, the magnetic field is spread over the periphery of the electric conductor, and a leakage magnetic flux is large, thereby being incapable of applying an effective magnetic field.

SUMMARY OF THE INVENTION

An object of the present invention is to solve the above-mentioned problems with the conventional continuous casting devices.

In order to solve the above problem, the present invention has been achieved by the provision of a continuous casting device. A pair of cooling rolls rotate in opposite directions to each other. A pair of side are provided one of which surrounds the peripheral surface of one of the cooling rolls and the other of which surrounds the end surface or the peripheral surface of the other of the cooling rolls. At least one of the cooling rolls and the side weirs are movable axially of the cooling rolls. Electromagnets for form a magnetic flux in a direction parallel with a contact surface of the side weirs with the molten, the contact surface extending metal along the peripheral surfaces of the cooling rolls and are provided in the vicinity of a portion of the side weirs along the peripheral surfaces of said cooling rolls.

According to the continuous casting device of the present invention, the magnetic flux is formed in a direction parallel with the contact surface of the side weirs with the molten metal along the peripheral surface of the cooling rolls in the vicinity of a portion of the side weirs along the peripheral surface of the cooling rolls. Its magnetic pressure (the Lorentz's force) allows the molten metal to be pushed back to thereby restrain the leakage of the molten metal.

In the above-mentioned continuous casting device of the present invention, it is preferable that the electromagnet is designed to be provided with ferromagnetic substances on the surfaces of the side weirs which are opposed to the cooling rolls and on the surfaces of the side weirs which are opposed to the molten metal. With this structure, the magnetic flux is concentrated along the molten metal and the cooling rolls, and the molten metal is effectively pushed back from the side weirs. Thereby the device is capable of eliminating contact of the molten metal with the side weirs in regions close to the peripheral surfaces of the cooling rolls. Also, it is preferable that the outside portions of the ferromagnetic substances are coupled to each other, thereby being capable of obtaining a higher magnetic flux density. Furthermore, it is preferable that the ferromagnetic substance is so designed as to be covered with a conductive plate, thereby being capable of restraining leakage magnetic flux and enhancing the concentrating effect of the magnetic flux.

Also, in order to solve the above problem, the present invention has been achieved by the provision of a continuous casting device which comprises a pair of cooling rolls that rotate in opposite directions to each other. A pair of side weirs are provided one of which surrounds the end surface or the peripheral surface of one of the cooling rolls and the other of which surrounds the peripheral surface of the other of the cooling rolls. At least one of the cooling rolls and the side weirs are movable in an axial direction of the cooling rolls. Electric conductors for forming a magnetic flux in a direction parallel with a contact surface of the side weirs with the molten metal along the peripheral surfaces of the cooling rolls are disposed in the vicinity of a portion of the side weirs along the peripheral surfaces of the cooling rolls. The electric conductors are classified into groups in which the directions of the currents in the electric conductors are identical with each other. A circuit into which a reverse current flows is formed in the electric conductor of each group, and a current flows in the same direction in the electric conductors opposed to the molten metal, and a ferromagnetic substance is provided between the electric conductors in each group.

Further, in order to solve the above problem, the present invention has been achieved by the provision of a continuous casting device which comprises a pair of cooling rolls that rotate in opposite directions to each other. One side weir surrounds the end surface of one of the cooling rolls and the other side weir surrounds the end surface of the other of the cooling rolls. Electric conductors form a magnetic flux in a direction parallel with a contact surface of the side weirs contacting the molten metal along the peripheral surface of the cooling rolls and provided in the vicinity of a portion of the side weirs along the peripheral surface of the cooling rolls. The electric conductors are classified into groups in which the directions of the currents in the electric conductors are identical with each other. A circuit into which a reverse current flows is formed in the electric conductor of each group, and a current flows in the same direction in the electric conductors opposed to the molten metal. A ferromagnetic substance is provided between the electric conductors in each group.

According to the thus organized continuous casting device of the present invention, the directions of the magnetic fluxes in the molten metal are identical with each other so that the magnetic fluxes do not interfere with each other. Therefore, the magnetic fluxes are not weakened, even at portions close to the cooling rolls, to thereby enhance the effect of preventing the leakage of the molten metal.

In the continuous casting device in accordance with the present invention, the electric conductors disposed in the side weirs can be located in such a manner that the directions of the currents in the electric conductor at the sides facing the molten metal along the peripheral surfaces of the respective cooling rolls at the portions where the pair of cooling rolls are closest to each other are identical with each other.

In this case, the electric conductors provided in the side weirs may be connected to a single a.c. power supply.

Also, in forming circuits that allow the currents to flow in opposite direction to each other, the electric conductor is turned back at a portion nearest to the pair of cooling rolls into a V-shape. This is preferable, in that the length of the cooling electric conductor can be prevented from becoming too long, the impedance of the cooling electric conductor can be kept small, and the capacity of the power supply can be reduced.

Furthermore, in arranging the electric conductors opposed to the end surface of the cooling roll, the ferromagnetic substances are arranged in a U-shape and opened at the end surface sides of the cooling rolls to surround the electric conductor into which a current flows in one direction. Also, in arranging the electric conductors opposed to the peripheral surfaces of the cooling rolls, the ferromagnetic substance is arranged in an L-shape and opened at the peripheral surface sides of the cooling rolls and the molten metal side to surround the electric conductor into which a current flows in one direction. The electric conductor into which a current flows in the other direction is arranged at an opposite side of the electric conductor into which a current flows in one direction with respect to the ferromagnetic substance. This is preferable in that the side weirs are made parallel with each other so that the magnetic flux can be concentrated on the molten steel. As a result, the Lorentz's force is more effectively exerted in a direction forcing the molten steel away from the electromagnet portion to thereby increase the sealing effect.

Also, a layer heat resisting material is disposed between the electric conductor and the molten metal. This is preferable in that heat is isolated between the electric conductor and the molten metal, thereby being capable of preventing the temperature from rising.

Further, in order to solve the above problem, the present invention has been achieved by the provision of a continuous casting device in which molten metal is poured into a space defined by a pair of cooling rolls that rotate and side weirs that close both the end surfaces of the cooling rolls, respectively, to continuously manufacture a casting piece. An electric conductor connected to an a.c. power supply is wired at a V-shaped portion as a whole along the peripheral surfaces of the cooling roll on the side weirs, to constitute an electromagnetic sealing type side weir that performs sealing by exerting a magnetic flux on the molten metal. The directions of the currents flowing in the right and left electric conductors at the sides facing the molten metal are identical with each other.

In the continuous casting device of the present invention, it is preferable that the directions of the currents flowing in the right and left electric conductors at the sides facing the molten metal are identical with each other at the portions closest to at least the pair of cooling rolls. The electric conductors which are wired on the two side weirs that close both the end surfaces of said cooling roll can be connected in parallel with one a.c. power supply.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

A description will now be given in more detail of embodiments of the present invention with reference to the accompanying drawings.

Figure 20:
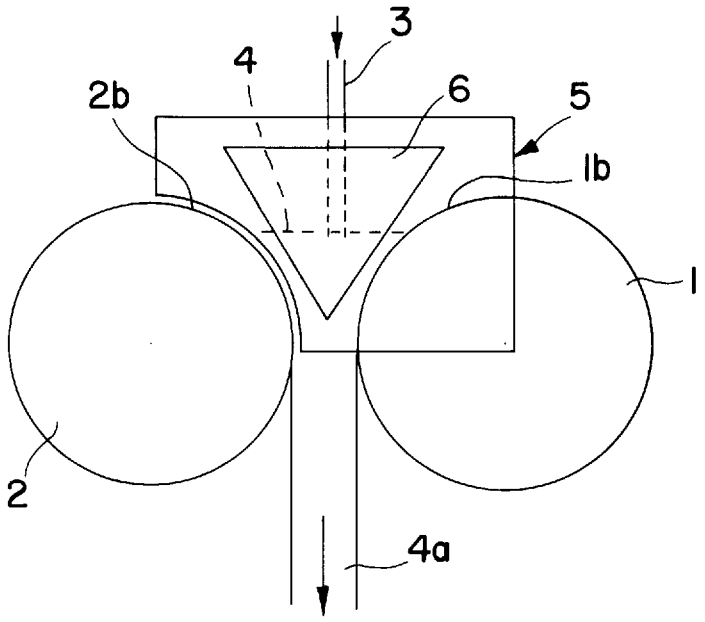
FIG. 20 PRIOR ART
FIG. 20 is a schematic front view showing one example of a conventional continuous casting device.
Figure 21:
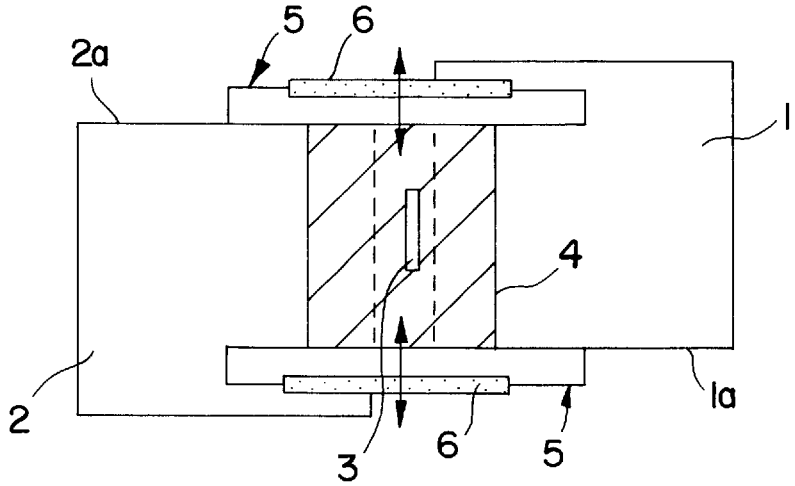
FIG. 21 PRIOR ART
FIG. 21 is a plan view showing the conventional continuous casting device of FIG. 20.

A continuous casting device in accordance with a first embodiment of the present invention is shown in FIGS. 1 to 8. It should be noted that the same parts as those shown in FIGS. 20 and 21 are designated by the same symbols, and the duplicate description will be omitted.

As shown in FIGS. 1 to 8, an electromagnet is made up of a cooling electric conductor 13 disposed so as to be embedded in each side weir 11, and an a.c. power supply 14 connected to the cooling electric conductor 13. Also, in the case where one of the side weirs 11 is so designed as to cover the peripheral surface 2*b* of one cooling roll 2, whereas the other of the side weirs 11 is so designed as to cover the end surface 1*a* of the other cooling roll 1, the width of a band-like plate 4*a* to be cast is changed with the movement of the side weirs 11 and the cooling rolls 1, 2. In the case where the side weirs 11 are so designed as to cover the peripheral surfaces 1*b* and 2*b* of both the cooling rolls 1 and 2, the width of the band-like plate 4*a* to be cast is changed with the movement of the side weirs 11.

Also, a continuous casting device in accordance with a second embodiment of the present invention is shown in FIGS. 9 to 18. It should be noted that the same parts as those shown in FIGS. 20 and 21 and those shown in FIGS. 1 to 8 are designated by the same symbols, and duplicate description will be omitted.

In this embodiment, since a cooling electric conductor is folded back at a portion which is the closest to a pair of cooling rolls, so as to be formed into a V-shape, the impedance of the cooling electric conductor is kept small without the length of the cooling electric conductor being lengthened, and the capacity of a power supply can be reduced to produce the Lorentz's force. Also, since the same-direction current is allowed to flow in the cooling electric conductors which are opposed to the molten steel, the directions of the magnetic fluxes in the molten steel are identical with each other, and the magnetic fluxes do not interfere with each other. More particularly, the magnetic fluxes are not weakened at the portions close to the cooling rolls.

Figure 11:
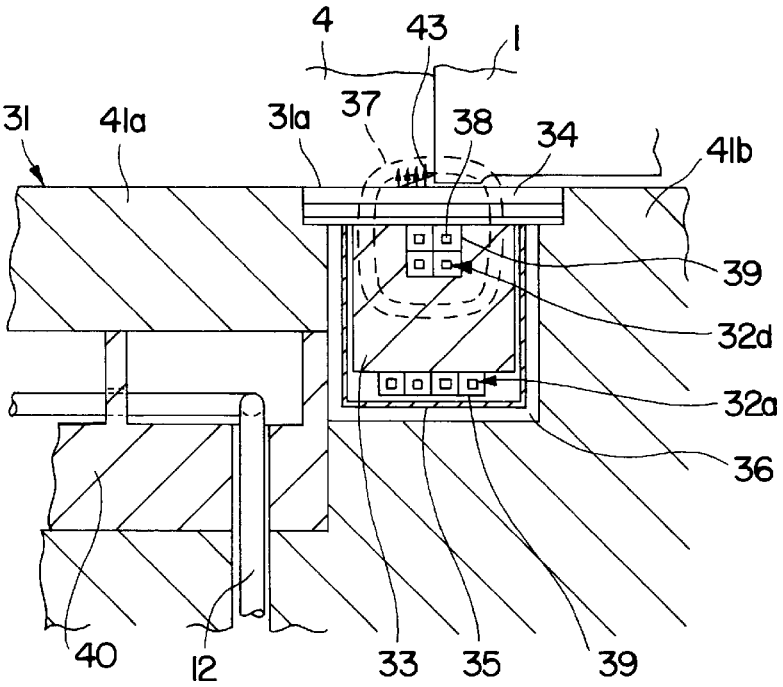
FIG. 11 is an enlarged view showing the continuous casting device taken along a line 11—11 of FIG. 9.

Also, since the cooling electric conductor is arranged as shown in FIG. 11, and a ferromagnetic substance is arranged in a U-shape so as to surround the cooling electric conductor, the side weirs are made in parallel with each other so that the magnetic flux can be concentrated on the molten steel. As a result, the Lorentz's force is more effectively exerted in a direction arcing the molten steel away from the electromagnet portion, to thereby increase the sealing effect. Also, as shown in FIG. 12, in the case where the peripheral surface of the cooling roll is opposed to the cooling electric conductor, since the cooling electric conductors are disposed inside and outside of the ferromagnetic substance, which is L-shaped in section to form an electromagnet, the action of the nickel plating of the cooling rolls as the ferromagnetic substance allows the magnetic fluxes to be formed at the portions of the molten steel which are in contact with the side weirs to thereby effectively exert the Lorentz's force that pushes back the molten steel.

Figure 12:
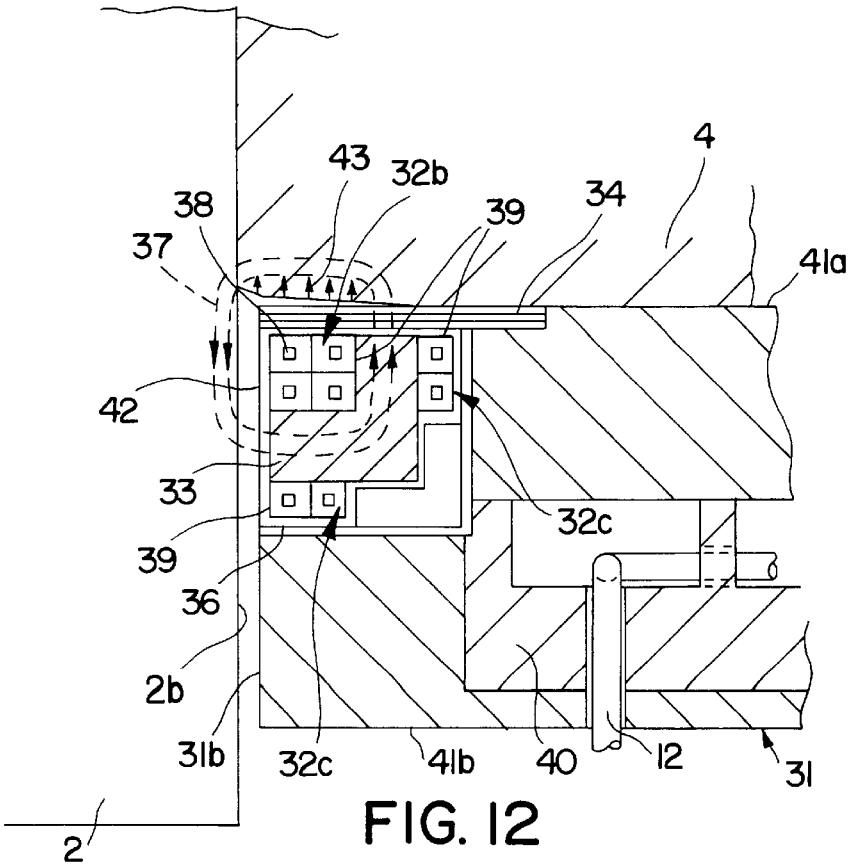
FIG. 12 is an enlarged view showing the continuous casting device taken along a line 12—12 of FIG. 9.

Also, as shown in FIGS. 11 and 12, since a layer-shaped heat resisting material is disposed between the electric conductor and the molten metal, heat is isolated between the electric conductor and the molten metal.

Hereinafter, first and second embodiments of the present invention will be described in more detail.

(First Embodiment)

The first embodiment of the present invention will be described with reference to FIGS. 1 to 8. It should be noted that components identical with those shown in FIGS. 20 and 21 are represented by the same symbols, and the duplicate description will be omitted.

Figure 1:
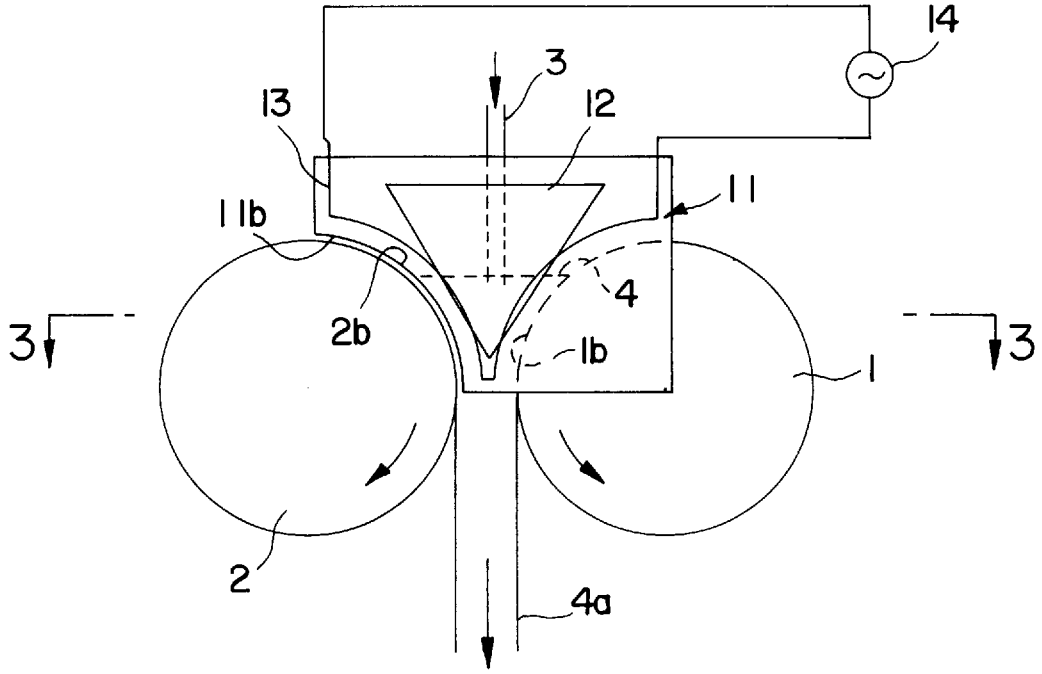
FIG. 1 is a schematic front view showing a continuous casting device in accordance with one embodiment of the present invention.
Figure 2:
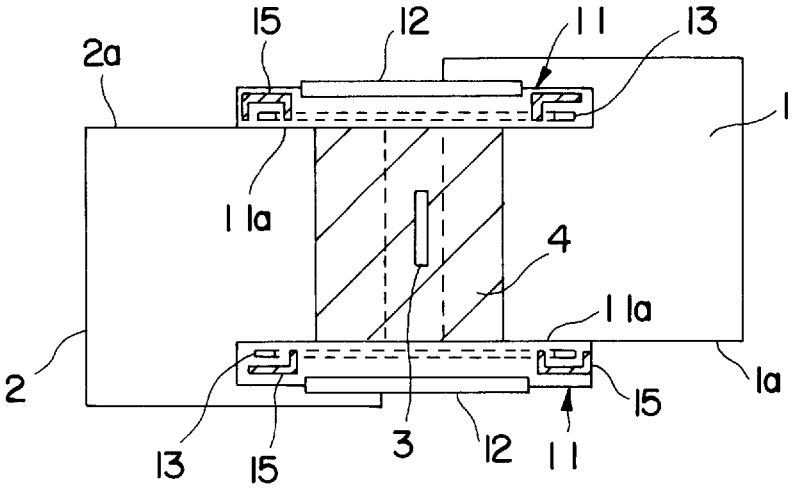
FIG. 2 is a plan view showing the continuous casting device of FIG. 1.
Figure 3:
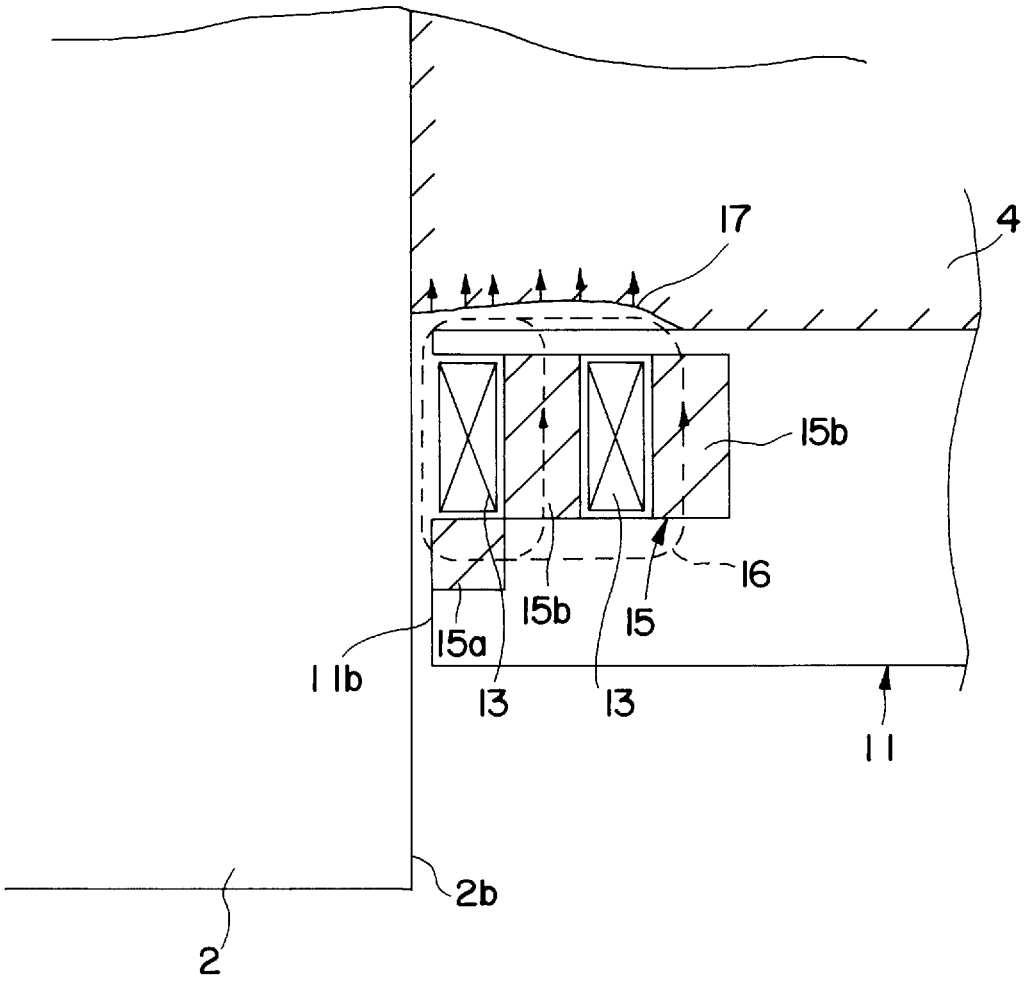
FIG. 3 is a partially enlarged cross-sectional view showing the continuous casting device taken along a line 3—3 of FIG. 1.

FIG. 1 is a schematic front view showing a continuous casting device in accordance with the first embodiment of the present invention, FIG. 2 is a plan view thereof, and FIG. 3 is a partially enlarged view taken along a line A—A in FIG. 1.

In FIG. 1, reference numerals 1 and 2 denote a pair of cooling rolls which are opposed to each other, which are designed in such a manner that their surfaces that are opposed to each other are moved downward while being rotatably driven. At least one of the cooling rolls 1 and 2 is movable in an axial direction. The cooling rolls 1 and 2 are made of, for example, a copper alloy which is subjected to nickel plating, and both the end surfaces of those cooling rolls 1 and 2 are made of an electromagnetic steel plate. A molten metal supply nozzle 3 is confronted by a valley-shaped space defined between those cooling rolls 1 and 2 so that a molten steel (for example, stainless steel, common steel, etc.) supplied from the supply nozzle 3 is accumulated in the valley-shaped space defined between the cooling rolls 1 and 2.

A pair of side weirs 11 are disposed to have an inner surface 11*a* with which an end surface 1*a* or 2*a* of one cooling roll 1 or 2 is covered, and a circular surface 11*b* with which a peripheral surface 2*b* or 1*b* of the other cooling roll 2 or 1 is covered. The side weirs 11 are made of a heat resistant insulating material such as ceramics. A heater 12 for heating is disposed on the outer side surface of each side weir 11.

A cooling electric conductor (an exciting coil) 13 is located within each side weir 11. The cooling electric conductor 13 is arranged in the vicinity of a circular portion which is in contact with the cooling rolls 1, 2, the side weirs 11 and the molten steel 4. For example, the cooling electric conductor 13 is disposed inside of the side weir 11 in such a manner that the circular surface 11*b* side of the side weir 11 is situated along the peripheral surface 2*b* of the cooling roll 2 and also along the molten steel 4 side, as shown in FIG. 3. The cooling electric conductor 13 is connected with an a.c. power supply 14. Each of ferromagnetic substances 15 are so disposed as to surround each cooling electric conductor 13. Each ferromagnetic substance 15 has a portion 15*a* which is directed to the circumferential side of the cooling roll 1 or 2, and a portion 15*b* which is directed to the molten steel 4 side.

In the continuous casting device thus organized, the inner side surface 11*a* of one side weir 11 is in contact with the end surface 1*a* or 2*a* of the cooling roll 1 or 2, and the circular surface l1*b* of the side weir 11 is in contact with the peripheral surface 2*b* or 1*b* of the other cooling roll 2 or 1, when the continuous casting device starts to operate. In this state, the molten steel 4 is supplied from the supply nozzle 3 in such a manner that the molten steel 4 is accumulated in the valley-shaped space between the cooling rolls 1 and 2 up to a given level. When the molten steel 4 is accumulated therein up to the given level, the operation of the continuous casting device is started, and a predetermined interval is maintained between the side weirs 11 and the cooling rolls 1, 2.

Upon the application of an a.c. current (frequency of about 0.5 to 10 kHz, 1 to 2 kHz in practical use) to the cooling electric conductors 13, a magnetic flux 16 is developed around the cooling electric conductors 13. The magnetic flux 16 allows an induction current to flow in the molten steel 4, and the interaction of the induction current and the magnetic flux 16 allows a magnetic pressure (the Lorentz's Force) 17 to be exerted in a direction of pushing back the molten steel 4.

In this example, the ferromagnetic substances 15 are disposed so as to confront the peripheral surfaces 1*b* and 2*b* side of the cooling rolls 1 and 2 and the molten steel 4 side. The magnetic flux 16 is concentrated along the molten steel 4 and the cooling roll 2, and the molten steel 4 is effectively pushed back from the side weirs 11, thereby being capable of eliminating contact by molten steel 4 with the side weirs 11 in a region close to the periphery of the cooling rolls 1 and 2. In this state, with the rotation of the cooling rolls 1 and 2, a band-like plate 4*a* having no defect on the ends thereof is continuously cast with stability.

Figure 4:
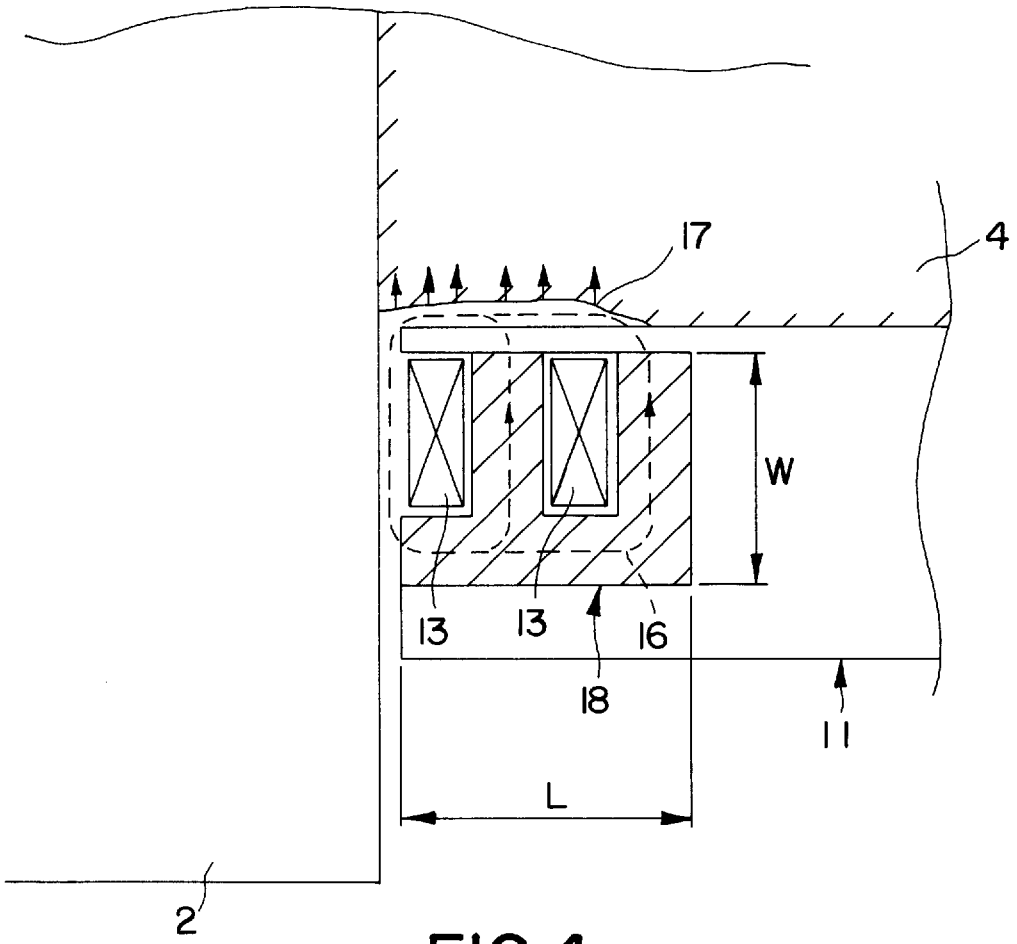
FIG. 4 is a cross-sectional view showing a portion of a continuous casting device in accordance with another embodiment of the present invention, which corresponds to that of FIG. 3.

The ferromagnetic substances may be formed of ferromagnetic substances 18, the outer portions of which are integrally connected to each other, as shown in FIG. 4. In this way, a closed magnetic path is formed, thereby being capable of obtaining a higher magnetic flux density. In this example, when the thickness W of the ferromagnetic substance 18 is 48 mm and the width L is 24 mm, then an electromagnetic field is calculated with a magnetomotive force (frequency of 1 kHz) given to the cooling electric conductor 13 as a parameter. The results of calculating the magnetic field density in the region close to a portion which is in contact with the peripheral surfaces 1*b* and 2*b* of the cooling rolls 1 and 2, the side weirs 11 and the molten steel 4, as well as a magnetic force exerted on the molten steel 4, are shown in FIG. 5.

Figure 5:
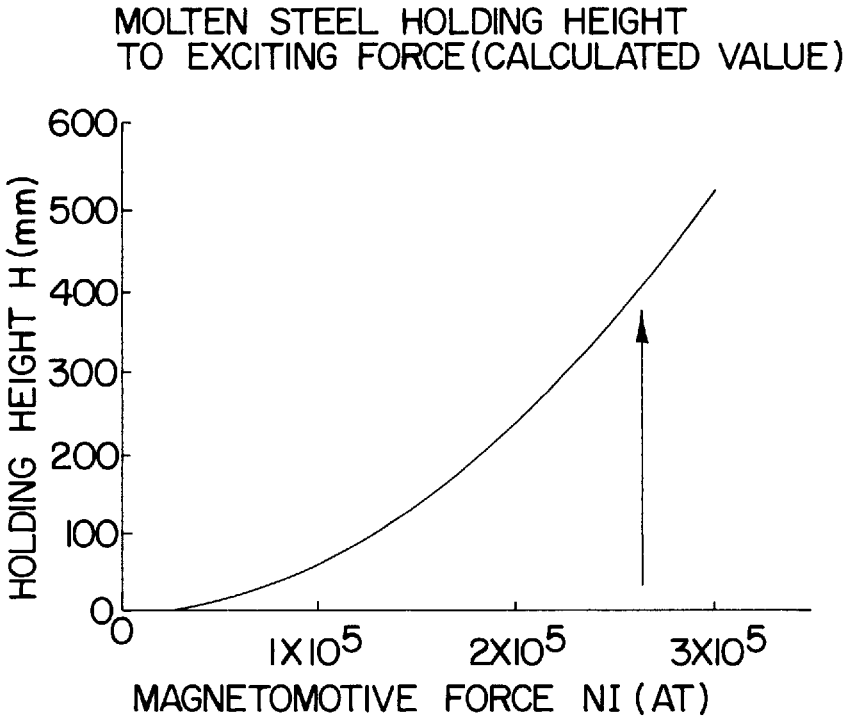
FIG. 5 is a graph representing a relationship of a molten holding height to a magnetomotive force.

It is estimated from FIG. 5 that a magnetomotive force of $2.65\times10^5$ AT enables holding at 400 mm, which is the height of a liquid in a practically used device, as the height of the molten steel 4 accumulated between two cooling rolls 1, 2 and the side weirs 11.

Figure 6:
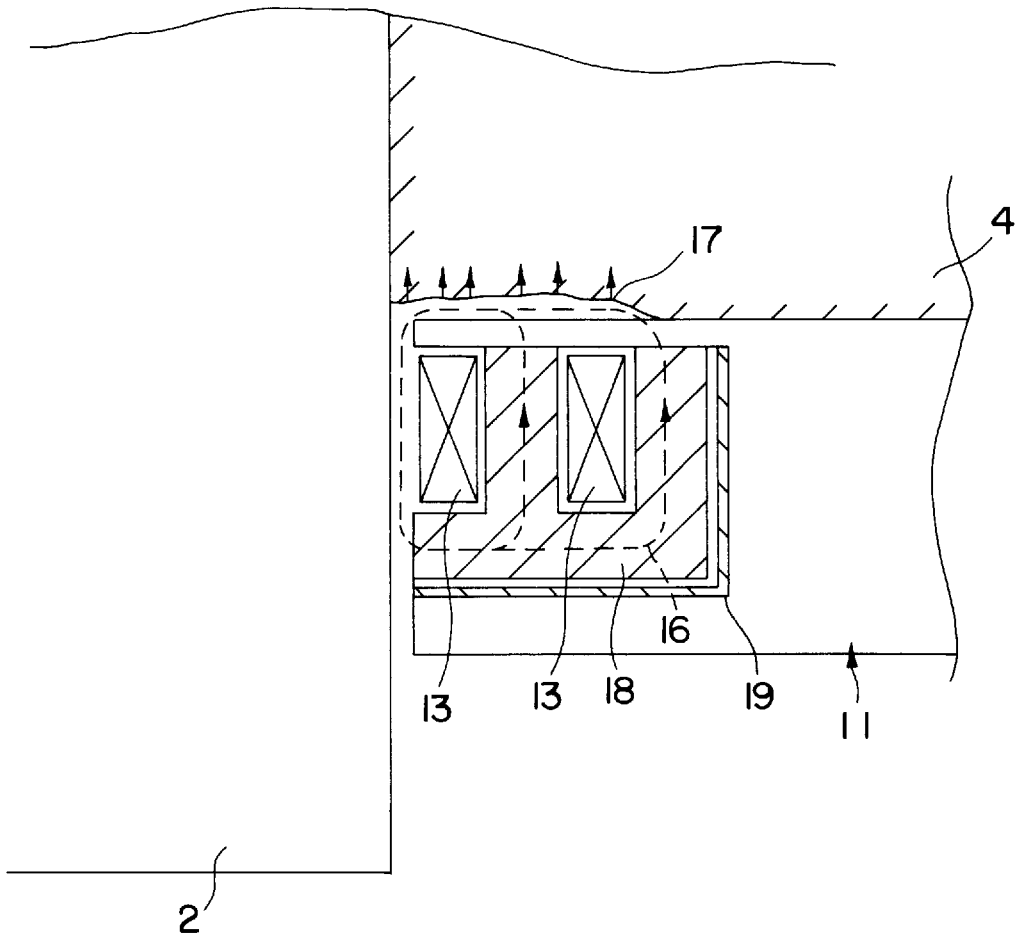
FIG. 6 is a cross-sectional view showing a portion of a continuous casting device in accordance with still another embodiment of the present invention, which corresponds to that of FIG. 3.

Furthermore, as shown in FIG. 6, a conductor plate 19 such as steel, which shields a magnetic flux, is located outside of the ferromagnetic substance 18 shown in FIG. 4. A gap or opening conductor plate 19 is defined in a region where magnetic flux is to be effectively exerted, thereby being capable of restraining leakage flux and enhancing the concentrating effect of the magnetic flux.

It should be noted that in the device shown in FIGS. 1 and 2, the cooling roll 1 or 2 is axially moved together with the side weirs 11 to thereby change an interval between the respective side weirs 11, that is, to change the width of the plate.

Figure 7:
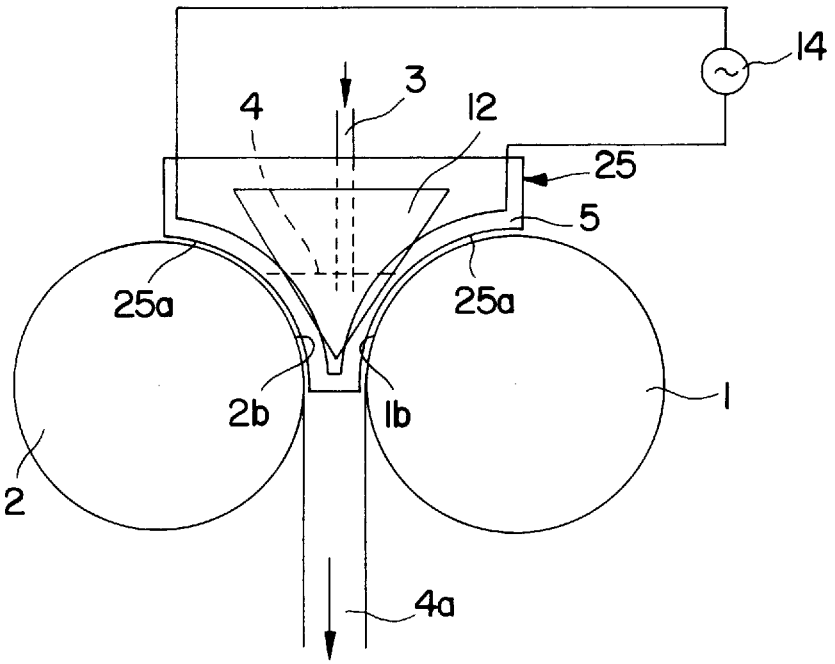
FIG. 7 is a schematic front view showing a continuous casting device in accordance with still another embodiment of the present invention.
Figure 8:
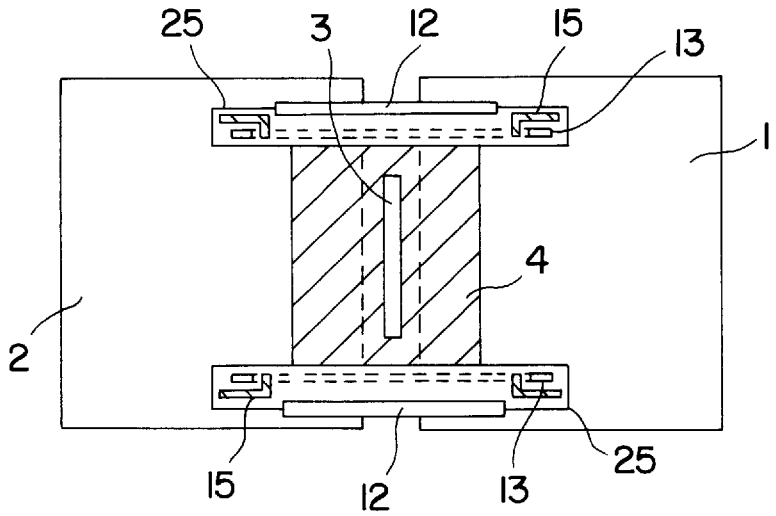
FIG. 8 is a plan view showing the continuous casting device of FIG. 7.

FIG. 7 is a schematic front view showing a continuous casting device in accordance with a modification of the first embodiment of the present invention, and FIG. 8 is a plan view thereof. This modified embodiment is designed so that both side surfaces of a pair of side weirs 25 cover the peripheral surfaces 1*b* and 2*b* of a pair of cooling rolls 1 and 2. In other words, circular surfaces 25*a* are formed on both sides of the side weirs 25 so as to cover the peripheral surfaces 1*b* and 2*b* of the cooling rolls 1 and 2. Unlike the preceding example, in this example, the side weirs 25 are moved in an axial direction of the cooling rolls 1 and 2, thereby being capable of arbitrarily changing the width of the band-like plate 4*a*. In this example, the cooling electric conductor 13 is disposed along the circular surfaces 25*a* of both the side weirs 25 and also in the vicinity of the inside thereof. Other structures are identical with those of the embodiment shown in FIGS. 1 and 2. Also, the structure in which the ferromagnetic substance 18 and the conductor plate 19 can be provided on the cooling electric conductor 13 as shown in FIGS. 3 to 5 is also identical with that of the preceding embodiment.

(Second Embodiment)

The second embodiment of the present invention will be described with reference to FIGS. 9 to 18. It should be noted that components identical with those shown in FIGS. 1 to 8, 20 and 21 are represented by the same symbols, and duplicate description will be omitted.

Figure 9:
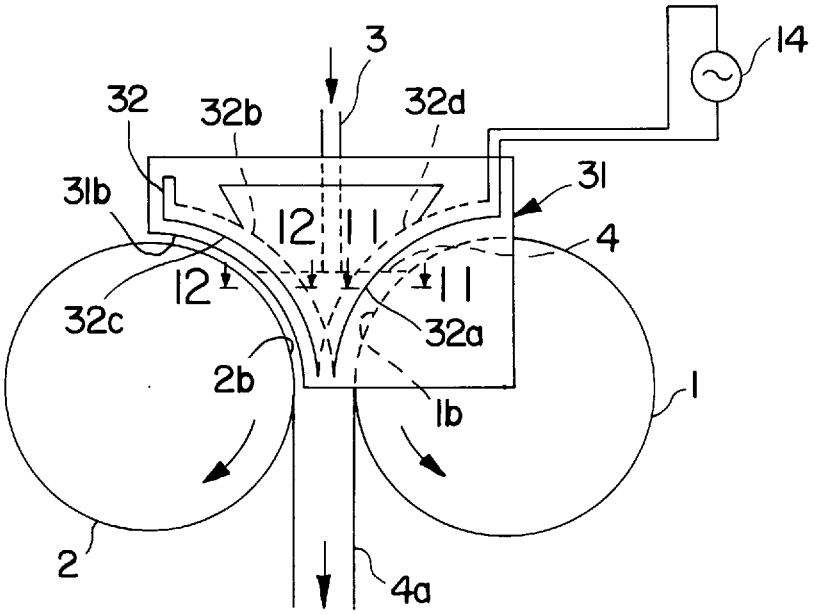
FIG. 9 is a schematic front view showing a continuous casting device in accordance with yet another embodiment of the present invention.
Figure 10:
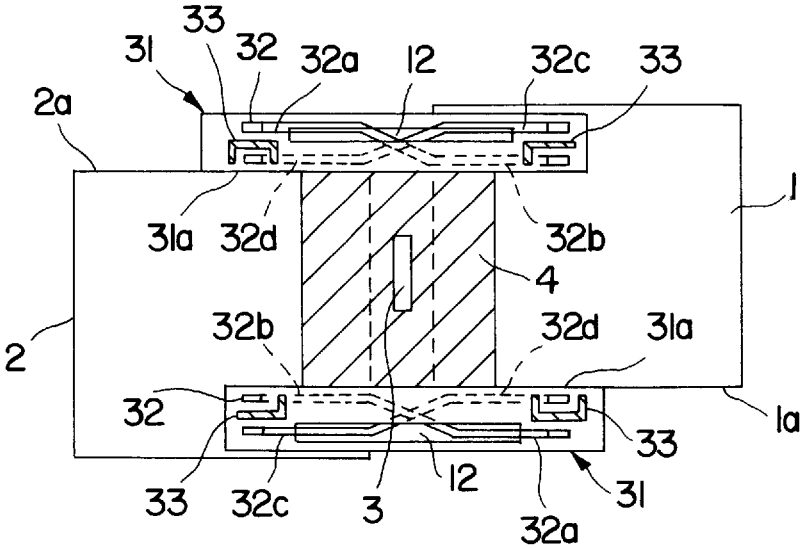
FIG. 10 is a front view showing the continuous casting device of FIG. 9.

In FIGS. 9 and 10, reference numerals 1 and 2 denote a pair of cooling rolls which are opposed to each other, and which are designed in such a manner that their surfaces opposed to each other are moved downward while being rotatably driven. A molten metal supply nozzle 3 is confronted by a valley-shaped space defined between those cooling rolls 1 and 2 so that a molten steel supplied from the supply nozzle 3 is accumulated in the valley-shaped space defined between the cooling rolls 1 and 2.

A pair of side weirs 31 are disposed which have an inner surface 31*a* with which an end surface 1*a* or 2*a* of one cooling roll 1 or 2 is covered, and a circular surface 31*b* with which a peripheral surface 2*b* or 1*b* of the other cooling roll 2 or 1 is covered. Those side weirs 31 are made of a heat resistant insulating material such as ceramic. A heater 12 for heating is disposed within each side weir 31. Hereinafter, the description of the side weirs 31 is conducted on the side weir 31 on the lower side of FIG. 10, but the side weir 31 on the upper side of FIG. 10 is identical in structure with that on the lower side thereof, except that the locations of the cooling rolls 1 and 2 which are opposed to each other are different therebetween.

A cooling electric conductor 32 is located within each side weir 31. The cooling electric conductor 32 is arranged along the vicinity of a circular portion which is in contact with the cooling rolls 1, 2, the side weirs 31 and the molten steel 4. For example, the cooling electric conductor 32 is disposed inside of the side weir 31 in such a manner that the circular surface 31*b* side of the side weir 31 is situated along the peripheral surface 2*b* of the cooling roll 2 and also along the molten steel 4 side, as shown in FIG. 9. The cooling electric conductor 32 is connected with a single a.c. power supply 14. Each of ferromagnetic substances 33 is so disposed as to surround each cooling electric conductor 32, which forms an electromagnet in cooperation with the ferromagnetic substance 33.

As shown in FIG. 9, the cooling electric conductor 32 is made up of a first separated portion 32*a* (indicated by a solid line in the figure), a first adjacent portion 32*b* (indicated by a dotted line in the figure), a second separated portion 32*c* (indicated by the solid line in the figure) and a second adjacent portion 32*d* (indicated by the dotted line in the figure). The first separated portion 32*a* extends from an a.c. power supply 14 to the vicinity of the lower end along the peripheral surface 1*b* of the cooling roll 1 at the right side in the figure and is positioned at a portion separated from the molten steel 4. The first adjacent portion 32*b* is contiguous to the separated portion 32*a*, is folded back at a portion close to the lower end, extends to the vicinity of the upper portion along the peripheral surface 2*b* of the cooling roll 2, and is positioned at a portion adjacent to the molten steel 4. The second separated portion 32*c* is contiguous to the adjacent portion 32*b*, is folded back at a portion close to the upper end portion, extends to the vicinity of the lower portion along the peripheral surface 2*b* of the cooling roll 2, and is positioned at a portion separated from the molten steel 4. The second adjacent portion 32*d* is contiguous to the second separated portion 32*c*, is folded back at a portion close to the lower end, extends to the vicinity of the upper portion along the peripheral surface 1*b* of the cooling roll 1, and is positioned at a portion adjacent to the molten steel 4.

In other words, the cooling electric conductor 32 is folded back at a portion closest to the cooling rolls 1 and 2 into a V-shape. It should be noted that FIG. 9 shows a state in which the first separated portion 32*a*, the first adjacent portion 32*b*, the second separated portion 32*c* and the second adjacent portion 32*d* are shifted from each other for convenience of description, however, in fact, those respective portions are overlapped with each other in a front view.

The first separated portion 32*a* and the second separated portion 32*c* of the cooling electric conductor 32, and the first adjacent portion 32*b* and the second adjacent portion 32*d* thereof are grouped by an identical current flowing direction in the cooling electric conductor 32, respectively. For example, a current flows downward in the first separated portion 32*a* and the second separated portion 32*c*, whereas a current flows upward in the first adjacent portion 32*b* and the second adjacent portion 32*d*. In the cooling electric conductors 32 of each group are formed circuits into which currents flow in directions opposite to each other. The ferromagnetic substance 33 is disposed between the cooling electric conductors 32 in each group, that is, between the first separated portion 32*a* and the second adjacent portion 32*d*, and between the second separated portion 32*c* and the first adjacent portion 32*b*, respectively.

Now, a description will be given of an arrangement of the cooling electric conductors 32 and the ferromagnetic substances 33 with reference to FIGS. 11 and 12. FIG. 11 shows a state in which the end surface 1*a* of the cooling roll 1 is covered with the inner surface 31*a* of the side weir 31, whereas FIG. 12 shows a state in which the peripheral surface 2*b* of the cooling roll 2 is covered with the circular surface 31*b* of the side weir 31.

As shown in FIG. 11, at a portion where the end surface 1*a* of the cooling roll 1 is covered with the side weir 31, there is disposed a U-shaped ferromagnetic substance 33 which is open at the end surface 1*a* side of the cooling roll 1, that is, the molten steel 4 side. Four second adjacent portions 32*d* of the cooling electric conductor 32 are disposed inside of the ferromagnetic substance 33 in a state where they are surrounded by the ferromagnetic substance 33. Those four second adjacent portions 32*d* are arranged at two stages in such a manner that two adjacent portions 32*d* are in parallel with each other at each stage. Four first separated portions 32*a* of the cooling electric conductor 32 are disposed on the back surface side of the ferromagnetic substance 33, and the four separated portions 32*a* are aligned. The four first separated portions 32*a* and the four second adjacent portions 32*d* are electrically insulated from each other by an insulator 39.

A heat resisting material 34 is disposed between the second adjacent portions 32*d* of the cooling electric conductor 32 and the molten steel 4 in the form of layers. The heat resisting material 34 is made up of a combination of layers which are thick at the side of the molten steel 4 and become thinner toward an opposite side of the molten steel 4 (for example, layers of 2.0 mm, 1.0 mm and 0.5 mm in thickness in order from the molten steel 4 side). The heat resisting material 34 insulates heat between the cooling electric conductor 32 and the molten steel 4. An insulating material 35 is disposed around the electromagnet which is formed of the cooling electric conductor 32 and the ferromagnetic substance 33, and an electromagnetic sealing material 36 is disposed around the insulating material 35. In this manner the outside of the electromagnet is surrounded by the electromagnetic sealing material 36, to thereby prevent the magnetic flux 37 from being leaked to the outside.

It should be noted that, in FIG. 11, reference numeral 38 denotes a cooling water within the cooling electric conductor (conduit) 32, reference numerals 41*a* and 41*b* denote heat resisting materials, and reference numeral 40 denotes a support material for the heater 12.

As shown in FIG. 12, at a portion where the peripheral surface 2*b* of the cooling roll 2 is covered with the side weir 31, the ferromagnetic substance 33 is disposed in an L-shape, the ends of which are directed to the molten steel 4 side and the peripheral surface 2*b* side of the cooling roll 2, respectively. Four first adjacent portions 32*b* of the cooling electric conductor 32 are disposed inside of the ferromagnetic substance 33 in a state where they are surrounded by the ferromagnetic substance 33. Those four first adjacent portions 32*b* are arranged at two stages in such a manner that two first adjacent portions 32*b* are in parallel with each other at each stage. Four second separated portions 32*c* of the cooling electric conductor 32 are disposed on the back surface side of the ferromagnetic substance 33 in two lines apart from each other. The four second separated portions 32*c* and the four first adjacent portions 32*b* are electrically insulated from each other by an insulator 39.

The heat resisting material 34 which is made up of the combination of layers as in the above-mentioned manner is disposed between the first adjacent portions 32*b* of the cooling electric conductor 32 and the molten steel 4. The heat resisting material 34 insulates heat between the cooling electric conductor 32 and the molten steel 4. The electromagnet which is formed of the cooling electric conductor 32 and the ferromagnetic substance 33 has heat resisting material fiber 42 wound in multilayers fixedly tied around it, to thereby ensure the electrical insulating property and the heat insulating property of the electromagnet at a side that faces the peripheral surface 2*b* of the cooling roll 2. Also, the outside of the electromagnet is surrounded by an electromagnetic sealing material 36, to thereby prevent the magnetic flux 37 from being leaked to the exterior.

Figure 14:
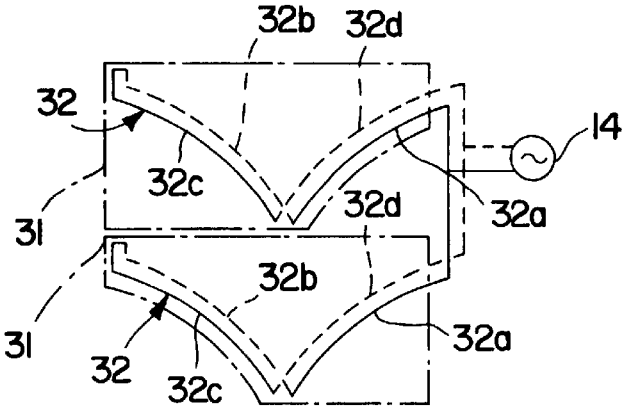
FIG. 14 is an explanatory diagram showing an example of the connection of a cooling electric conductor to an a.c. power supply.
Figure 15:
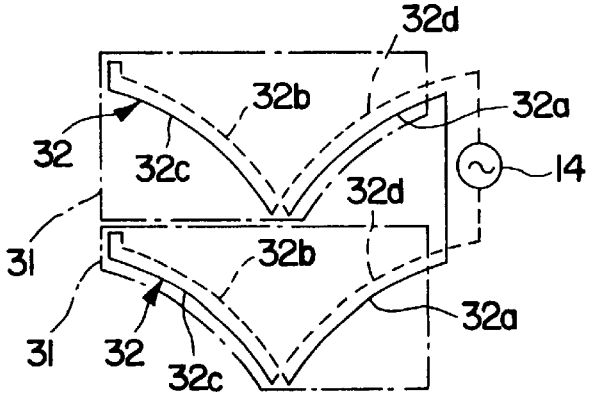
FIG. 15 is an explanatory diagram showing an example of the connection of a cooling electric conductor to an a.c. power supply.

In this example, examples of connecting the cooling electric conductor 32 thus organized to the a.c. power supply 14 will be described with reference to FIGS. 13, 14 and 15.

Figure 13:
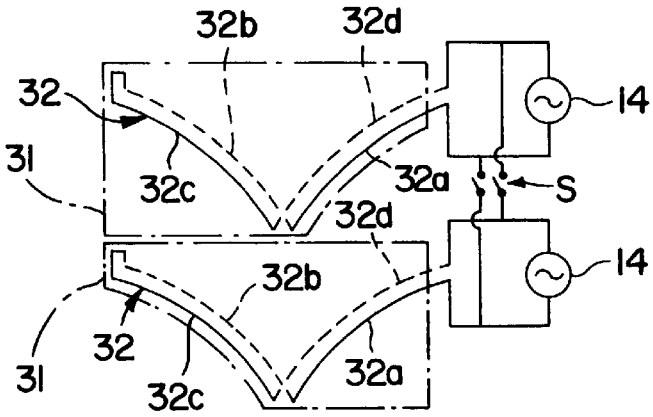
FIG. 13 is an explanatory diagram showing an example of the connection of a cooling electric conductor to an a.c. power supply.

In FIG. 13, the cooling electric conductor 32 disposed in one side weir 31 (lower side of FIG. 10) and the cooling electric conductor 32 disposed in the other side weir 31 (upper side of FIG. 10) are connected to two a.c. power supplies 14, respectively. Then, the cooling electric conductor 32 of one side weir 31 is so designed as to be connectable to the a.c. power supply 14 of the other side weir 31 by a switch S. In FIG. 14, the cooling electric conductor 32 disposed in one side weir 31 and the cooling electric conductor 32 disposed in the other side weir 31 are disposed in parallel with each other and connected to one a.c. power supply 14. In FIG. 15, the cooling electric conductor 32 disposed in one side weir 31 and the cooling electric conductor 32 disposed in the other side weir 31 are disposed in series and connected to one a.c. power supply 14.

Figure 16:
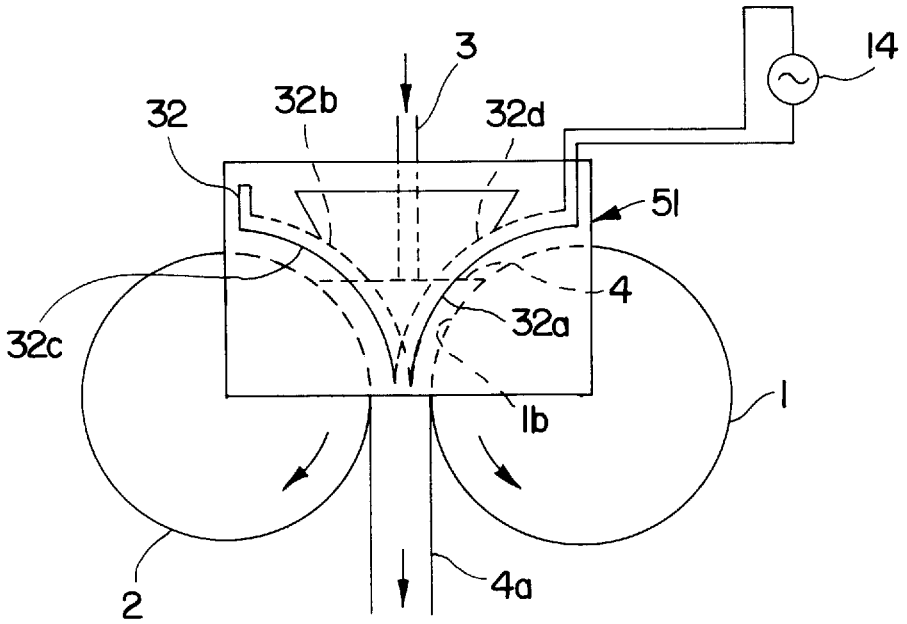
FIG. 16 is a schematic front view showing a continuous casting device in accordance with yet another embodiment of the present invention.
Figure 17:
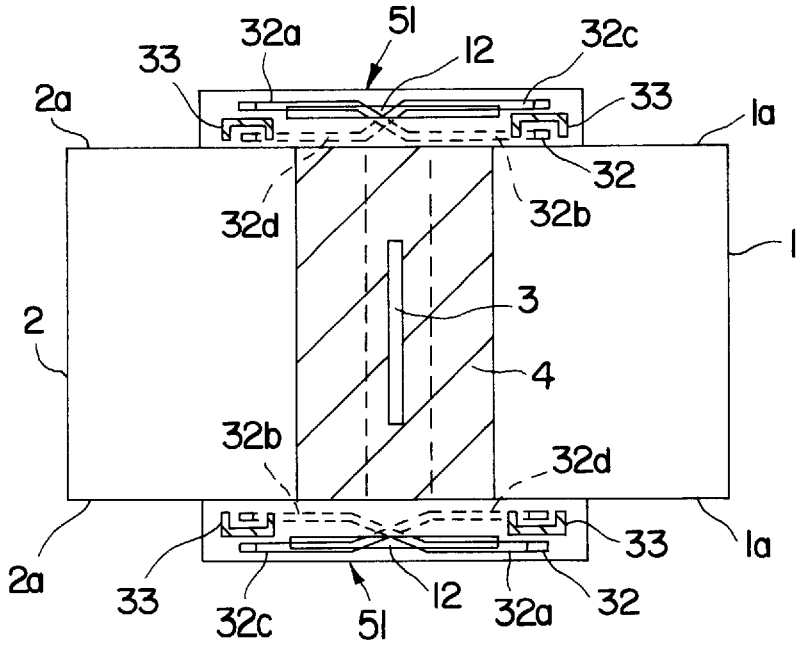
FIG. 17 is a schematic front view showing a continuous casting device in accordance with yet another embodiment of the present invention.

A description will be given of a modification of the second embodiment of the present invention with reference to FIGS. 16 and 17. FIG. 16 is a schematic front view showing a continuous casting device in accordance with the modification of the second embodiment of the present invention, and FIG. 17 is a plan view thereof. It should be noted that components identical with those shown in FIGS. 1 to 15, 20 and 21 are represented by the same symbols, and duplicate description will be omitted.

In FIGS. 16 and 17, reference numerals 1 and 2 denote a pair of cooling rolls which are opposed to each other, which are designed in such a manner that their surfaces opposed to each other are moved downward while being rotatably driven. A molten metal supply nozzle 3 is confronted by a valley-shaped space defined between those cooling rolls 1 and 2 so that a molten steel supplied from the supply nozzle 3 is accumulated in the valley-shaped space defined between the cooling rolls 1 and 2.

There are provided a pair of side weirs 51 that cover the end surfaces 1*a* and 2*a* of the cooling rolls 1 and 2 in such a manner that the cooling rolls 1 and 2 are not moved in an axial direction. In this example, unlike the preceding example (refer to FIG. 9 and others), the width of the band-like plate cannot be arbitrarily changed. Those side weirs 51 are made of a heat resistant insulating material such as ceramics as in the above-mentioned example, and a heater 12 for heating is disposed within each side weir 51. Both the adjacent portions 32*b* and 32*d* of the cooling electric conductor 32 are surrounded by the U-shaped ferromagnetic substances 33 (refer to FIG. 11).

Figure 18:
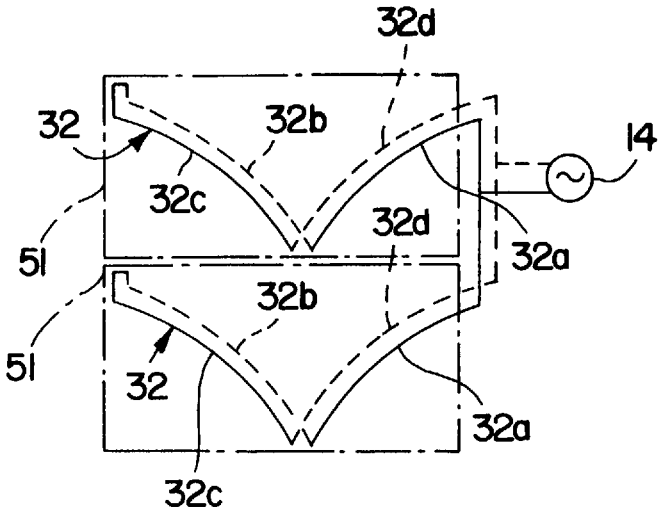
FIG. 18 is an explanatory diagram showing an example of the connection of a cooling electric conductor to an a.c. power supply.

An arranging state of the cooling electric conductor 32 in the side weirs 51 is shown in FIG. 18. As shown in the figure, the state in which the cooling electric conductor 32 is arranged is identical with that of the cooling electric conductor 32 in the side weir 31 shown in FIG. 14. Also, a state of connecting to the a.c. power supply 14 can be also applied with the example of FIGS. 13 or 14.

In the continuous casting device thus organized, the inner side surface 31*a* of one side weir 31 is in contact with the end surface 1*a* or 2*a* of the cooling roll 1 or 2, and the circular surface 31*b* of the side weir 31 is in contact with the peripheral surface 2*b* or 1*b* of the other cooling roll 2 or 1, when the continuous casting device starts to operate. Also, in the continuous casting device shown in FIGS. 16 and 17, the side weirs 51 are in contact with the end surface of the cooling rolls 1 and 2. In this state, the molten steel 4 is supplied from the supply nozzle 3 in such a manner that the molten steel 4 is accumulated in the valley-shaped space between the cooling rolls 1 and 2 up to a given level. When the molten steel 4 is accumulated therein up to the given level, the operation of the continuous casting device is started, and a predetermined interval is held between the side weirs 31 and the cooling rolls 1, 2.

Upon the application of an a.c. current (frequency of about 0.5 to 10 kHz, 1 to 2 kHz in practical use) to the cooling electric conductors 32, a magnetic flux 37 is developed around the first adjacent portion 32*b* and the second adjacent portion 32*d* of the cooling electric conductor 32, as shown in FIGS. 11 and 12. The magnetic flux 37 allows an induction current to flow in the molten steel 4, and the interaction of the induction current and the magnetic flux 37 allows a magnetic pressure (the Lorentz's Force) 43 to be exerted in a direction of pushing back the molten steel 4.

Then, as shown in FIG. 9 and others, since the cooling electric conductor 32 is formed in a V-shape by folding back the cooling electric conductor 32 at portions closest to the cooling rolls 1 and 2, the length of the cooling electric conductor 32 is prevented from being lengthened more than a required length, the impedance of the cooling electric conductor 32 is kept small, and the capacity of the power supply is reduced in order to produce the Lorentz's force of the same level.

Also, the cooling electric conductors 32 are classified into groups where the direction of a current flowing into the cooling electric conductor 32 is identical with each other, and the currents flowing in the same direction are allowed to flow in the group adjacent to the molten steel 4, that is, in the first adjacent portion 32*b* and the second adjacent portion 32*d*, whereby the direction of magnetic flux in the molten steel 4 becomes identical, to thereby eliminate the mutual interference. In particular, the magnetic fluxes are not weakened at the portions close to the cooling rolls 1 and 2.

Figure 19A:
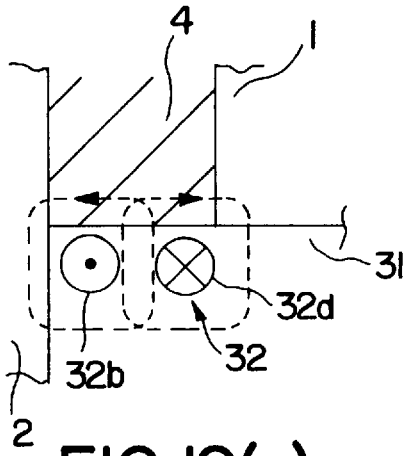
FIG. 19 is an explanatory diagram showing the state of a magnetic flux in the case where the currents flowing into one adjacent portion and a second adjacent portion of the cooling electric conductor are identical in the direction with each other and a case where the current flowing into the adjacent portion and the second adjacent portion of the cooling electric conductor are different in direction from each other.
Figure 19B:
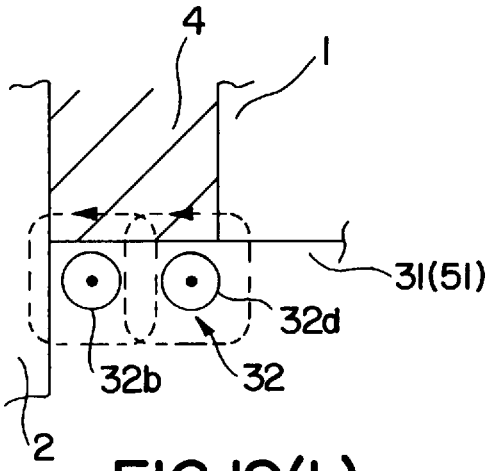

FIGS. 19(*a*) and 19(*b*) show a state of the magnetic flux in the case where the directions of current flowing into the first adjacent portion 32*b* and the second adjacent portion 32*d* of the cooling electric conductor 32 are identical with each other, and a state of the magnetic flux in the case where they are different from each other. As shown in FIG. 19(*a*), in the case where the directions of current flowing into the first adjacent portion 32*b* and the second adjacent portion 32*d* are different from each other, the magnetic flux developed around the first adjacent portion 32*b* and the magnetic flux developed around the second adjacent portion 32*d* are opposite in direction to each other in the molten steel 4. For that reason, in particular, at a portion where the cooling rolls 1 and 2 are close to each other such that both the magnetic fluxes overlap with each other (a portion where the first adjacent portion 32*b* and the second adjacent portion 32*d* are close to each other), the magnetic fluxes interfere with each other so as to be weakened. On the contrary, as shown in FIG. 19(*b*), in the case where the directions of current flowing into the first adjacent portion 32*b* and the second adjacent portion 32*d* are identical with each other, the magnetic flux developed around the first adjacent portion 32*b* and the magnetic flux developed around the second adjacent portion 32*d* are identical in the direction with each other in the molten steel 4. For that reason, even at a portion where the cooling rolls 1 and 2 are close to each other such that both the magnetic fluxes overlap with each other, the magnetic flux is not weakened.

The lower portion where the cooling rolls 1 and 2 are close to each other is larger in a force that allows the molten steel 4 to leak out to the outside than the upper portion where the cooling rolls 1 and 2 are apart from each other. For that reason, in order to push back the molten steel 4, the lower side requires more Lorentz's force than that of the upper side. Hence, as described above, the magnetic fluxes are prevented from being weakened at the portions where the cooling rolls 1 and 2 are close to each other to prevent the Lorentz's force from being lowered at the close portion, thereby being capable of more surely sealing the molten steel 4.

Also, as shown in FIG. 11, at a portion where the side weir 31 covers the end surface 1*a* of the cooling roll 1, since the U-shaped ferromagnetic substance 33 is arranged in such a manner that it surrounds the second adjacent portion 32*d* of the cooling electric conductor 32, the magnetic flux 37 can be concentrated on the molten steel 4 in parallel with the side weir 31. As a result, the Lorentz's force 43 is more effectively exerted in a direction along which the molten steel 4 is away from the electromagnetic portion to increase the sealing effect.

Furthermore, because a closed magnetic path is formed by the U-shaped ferromagnetic substance 33, the molten steel 4 and the cooling roll 1 (electromagnetic steel plate of the end surfaces), the molten steel side portion of the magnetic flux 37 extends from the molten steel 4 to the cooling roll 1 so as to pass through a boundary between the molten steel 4 and the outer periphery 1*b* of the cooling roll 1. For that reason, the Lorentz's force 43 is effectively exerted on the contact portion of the molten steel 4 with the outer periphery 1*b* of the cooling roll 1, which is important in sealing of the molten steel 4.

Also, at the portion where the peripheral surface 2*b* of the cooling roll 2 is covered with the side weir 31, because a closed magnetic path is formed by the L-shaped ferromagnetic substance 33, the molten steel 4 and the cooling roll 2 (due to the action as the ferromagnetic substance of nickel plating), the magnetic flux 37 can be concentrated on the molten steel 4 in parallel with the side weirs 31, and the molten steel side portion of the magnetic flux 37 extends from the molten steel 4 to the cooling roll 2 so as to pass through a boundary between the molten steel 4 and the peripheral surface 2*b* of the cooling roll 2. For that reason, the Lorentz's force 43 is effectively exerted on the contact portion of the molten steel 4 with the outer periphery 2*b* of the cooling roll 2, which is important in sealing the molten steel 4.

Also, as shown in FIGS. 11 and 12, since a layer-shaped heat insulating material 34 is disposed between the cooling electric conductor 32 and the molten steel 4, heat is insulated between the cooling electric conductor 32 and the molten steel 4, thereby prevent the temperature of the cooling electric conductor 32 from rising.

Further, as shown in FIG. 13, in the case where both cooling electric conductors 32 are connected to two a.c. power supplies 14, respectively, even though one of those a.c. power supplies 14 is suspended, the other a.c. power supply 14 serves as backup by closing the switch S to thereby enhance the reliability of the device.

It should be noted that the continuous casting device of the present invention is not limited by or to the above-mentioned embodiments, and can be variously modified within the scope of the present invention.

As was described above, according to a continuous casting device of the present invention, there are provided a pair of cooling rolls that rotate in the opposite directions to each other; a pair of side weirs, one of which surrounds the peripheral surface of one of the cooling rolls and the other of which surrounds the end surface or the peripheral surface of the other of the cooling rolls, in which at least one of the cooling rolls and the side weirs are movable in an axial direction of the cooling rolls; and an electromagnet for forming a magnetic flux in a direction parallel with a contact surface of the side weirs with the molten metal along the peripheral surface of the cooling rolls in the vicinity of a portion of the side weirs along the peripheral surface of the cooling rolls. As a result, in a region where the cooling rolls are in contact with the side weirs, a magnetic flux is exerted vertically to the cooling rolls and in parallel with the side weirs, and its magnetic pressure allows the molten metal to be pushed back, to thereby restrain the leakage of the molten metal. Also, since the molten metal is prevented from being solidified in the region where it is in contact with the side weirs, no defective portion occurs on the end portions of a band-like plate which is a casting product. Furthermore, non-contact portions of the side weirs with the cooling rolls can be moved in changing the width of the plate.

Also, since the electromagnet is designed to provide ferromagnetic substances on the surfaces of the side weirs which are opposed to the cooling rolls and on the surfaces of the side weirs which are opposed to the molten metal, the magnetic flux is concentrated along the molten metal and the cooling rolls, and the molten metal is effectively pushed back from the side weirs. Therefore, contact of the molten metal with the side weirs can be eliminated in the region close to the peripheral surface of each cooling roll, thereby more effectively preventing the leakage of the molten metal and the occurrence of defective portions on the end portions of the casting product. Also, since the outside portions of the ferromagnetic substances are coupled to each other, a higher magnetic flux density can be obtained, thereby enhancing the effects of preventing the leakage of the molten metal and the occurrence of defective portions on the end portions of the casting product. Furthermore, since the ferromagnetic substance is covered with the conductive plate, the leakage flux is restrained, thereby being capable of enhancing the concentrating effect of the magnetic flux, thus enhancing the effects of preventing the leakage of the molten metal and the occurrence of defective portions on the end portions of the casting product.

Also, according to the continuous casting device of the present invention, there are provided a pair of cooling rolls that rotate in the opposite directions to each other; a pair of side weirs, one of which surrounds the end surface or the peripheral surface of one of the cooling rolls and the other of which surrounds the peripheral surface of the other of the cooling rolls, in which at least one of the cooling rolls and the side weirs is movable in an axial direction of the cooling rolls. Electric conductors form a magnetic flux in a direction parallel with a contact surface of the side weirs with the molten metal along the peripheral surface of the cooling rolls in the vicinity of a portion of the side weirs along the peripheral surface of the cooling rolls, in which the electric conductors are classified into groups in which the direction of the currents in the electric conductors are identical with each other. A circuit into which a reverse current flows is formed in the electric conductor of each group. A current flows in the same direction in the electric conductors opposed to the molten metal. A ferromagnetic substance is provided between the electric conductors in each group. As a result, the directions of the currents flowing in the molten metal are identical with each other so that currents do not interfere with each other, and more particularly, the magnetic flux is not weakened on the portion close to each cooling roll.

Furthermore, according to the continuous casting device of the present invention, there are provided a pair of cooling rolls that rotate in opposite directions to each other, one side weir that surrounds the end surface of one of the cooling rolls and an other side weir that surrounds the end surface of the other of the cooling rolls. Electric conductors form a magnetic flux in a direction parallel with a contact surface of the side weirs with the molten metal along the peripheral surface of the cooling rolls in the vicinity of a portion of the side weirs along the peripheral surface of the cooling rolls. The electric conductors are classified into groups in which the directions of the currents in the electric conductors are identical with each other. A circuit into which a reverse current flows is formed in the electric conductor of each group, and a current flows in the same direction in the electric conductors opposed to the molten metal. A ferromagnetic substance is provided between the electric conductors in each group. As a result, the directions of the currents flowing in the molten metal are identical with each other so that currents do not interfere with each other, and more particularly, the magnetic flux is not weakened on the portion close to each cooling roll.

Also, since the electric conductor is turned back at a portion nearest to the pair of cooling rolls into a V-shape in forming circuits in which currents flow in opposite directions to each other, the length of the cooling electric conductor is prevented from being lengthened, the impedance of the cooling electric conductor is kept small, and the capacity of the power supply is reduced in order to produce the Lorentz's force of the same level.

Furthermore, the electric conductor is opposed to the end surface of the cooling roll. The ferromagnetic substance 33 is arranged in a U-shape and opened at the end surface side of the cooling roll to surround the electric conductor into which a current flows in one direction. The electric conductor is opposed to the peripheral surface of the cooling roll. The ferromagnetic substance is arranged in an L-shape and opened at the peripheral surface side of the cooling roll and the molten metal side to surround the electric conductor into which a current flows in one direction. The electric conductor into which a current flows in the other direction is disposed at an opposite side of the electric conductor into which a current flows in one direction with respect to the ferromagnetic substance. As a result, the magnetic flux can be concentrated on the molten steel in parallel with the side weirs, and the Lorentz's force is more effectively exerted in a direction in which the molten steel is away from the electromagnetic portion to increase the sealing effect. The ferromagnetic substance allows the magnetic flux to be developed on a portion where the molten metal is in contact with the side weirs to thereby effectively exert the Lorentz's force that pushes back the molten metal.

Since the layer-shaped heat resisting material is disposed between the electric conductor and the molten metal, heat is isolated between the electric conductor and the molten metal to thereby prevent the temperature of the electric conductor from rising.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A continuous casting device, comprising:

a pair of cooling rolls positioned adjacent to each other for rotation in opposite directions, each of said cooling rolls having an axial direction, a peripheral surface and an end surface;

a pair of side weirs, said pair of side weirs comprising a first side weir extending around said peripheral surface of one of said cooling rolls and a second side weir that has a position selected from the group consisting of a first position in which said second side weir covers said end surface of the other of said cooling rolls and a second position in which said second side weir extends around said peripheral surface of the other of said cooling rolls, wherein at least one of said cooling rolls and at least one of said side weirs are movable in the axial direction of said cooling rolls, and wherein said side weirs have portions that extend along said peripheral surfaces of said cooling rolls and molten metal contact surfaces; and electromagnets located proximate to said portions of said side weirs that extend along said peripheral surfaces of said cooling rolls for forming a magnetic flux in a direction parallel to said molten metal contact surfaces of said side weirs and along said peripheral surfaces of said cooling rolls.

2. The device of claim 1, wherein said electromagnets comprise a ferromagnetic substances on surfaces of said side weirs that face one of said cooling rolls and at said molten metal contact surfaces of said side weirs.

3. The device of claim 2, wherein said ferromagnetic substances have outside portions that are coupled together.

4. The device of claim 3, wherein said ferromagnetic substances are covered with a conductive plate.

5. A continuous casting device, comprising:

a pair of cooling rolls positioned adjacent to each other for rotation in opposite directions, each of said cooling rolls having an axial direction, a peripheral surface and an end surface;

a pair of side weirs, said pair of side weirs comprising a first side weir extending around said peripheral surface of one of said cooling rolls and a second side weir that has a position selected from the group consisting of a first position in which said second side weir covers said end surface of the other of said cooling rolls and a second position in which said second side weir extends around said peripheral surface of the other of said cooling rolls, wherein at least one of said cooling rolls and at least one of said side weirs are movable in the axial direction of said cooling rolls, and wherein said side weirs have portions that extend along said peripheral surfaces of said cooling rolls and molten metal contact surfaces; and electric conductors located proximate to said portions of said side weirs that extend along said peripheral surfaces of said cooling rolls for forming a magnetic flux in a direction parallel to said molten metal contact surfaces of said side weirs and along said peripheral surfaces of said cooling rolls, wherein said electric conductors are classified into groups in which a current direction in said electric conductors are identical with each other, and wherein a circuit is formed such that one of said electric conductors of each of said groups has a reverse current flow from another of said electric conductors of each of said groups, and such that said electric conductors that are closest to said molten metal contact surfaces of said side weirs have a current flow in the same direction; and a ferromagnetic substance provided between said electric conductors of each of said groups.

6. The device of claim 5, wherein said electric conductors form a V-shape by turning back on themselves at a point at which said cooling rolls are closest to each other.

7. The device of claim 6, wherein:

first ones said electric conductors are disposed at portions of said side weirs that cover the end surfaces of said cooling rolls, and second ones of said electric conductors are disposed at portions of said side weirs that are disposed along the peripheral surfaces of said cooling rolls;

said ferromagnetic substance comprises U-shaped members open toward the end surfaces of said cooling rolls and surrounding the first ones of said electric conductors;

said ferromagnetic substance further comprises L-shaped members open toward the peripheral surfaces of said cooling rolls and toward said molten metal contact surfaces of said side weirs and surrounding the second ones of said electric conductors;

the first and second ones of said electric conductors being arranged such that current will flow therethrough in one direction, and the first and second ones of said electric conductors having further electric conductors of said electric conductors disposed at an opposite side of said ferromagnetic substance therefrom, said further electric conductors being arranged such that current will flow therethrough in a direction opposite to the one direction.

8. The device of claim 5, wherein a layered heat resistant material is disposed between said electric conductors and a space between said weirs used to receive molten metal.

9. A continuous casting device, comprising:

a pair of cooling rolls positioned adjacent to each other for rotation in opposite directions, each of said cooling rolls having an axial direction, a peripheral surface and an end surface;

one side weir that covers the end surface of one of said cooling rolls, and another side weir that covers the end surface of the other of said cooling rolls, said side weirs having portions disposed along the peripheral surface of each of said cooling rolls and molten metal contact surfaces;

electric conductors located proximate to said portions of said side weirs that extend along said peripheral surfaces of said cooling rolls for forming a magnetic flux in a direction parallel to said molten metal contact surfaces of said side weirs and along said peripheral surfaces of said cooling rolls, wherein said electric conductors are classified into groups in which a current direction in said electric conductors are identical with each other, and wherein a circuit is formed such that one of said electric conductors of each of said groups has a reverse current flow from another of said electric conductors of each of said groups, and such that said electric conductors that are closest to said molten metal contact surfaces of said side weirs have a current flow in the same direction; and a ferromagnetic substance provided between said electric conductors of each of said groups.

10. The device of claim 9, wherein said electric conductors on said side weirs are arranged such that the current direction of said electric conductors closest to said molten metal contact surfaces are identical with each other.

11. The device of claim 10, wherein said electric conductors of said side weirs are connected to a single a.c. power supply.

12. The device of claim 11, wherein a layered heat resistant material is disposed between said electric conductors and a space between said weirs used to receive molten metal.

13. The device of claim 10, wherein a layered heat resistant material is disposed between said electric conductors and a space between said weirs used to receive molten metal.

14. The device of claim 9, wherein said electric conductors form a V-shape by turning back on themselves at a point at which said cooling rolls are closest to each other.

15. The device of claim 14, wherein:

first ones said electric conductors are disposed at portions of said side weirs that cover the end surfaces of said cooling rolls, and second ones of said electric conductors are disposed at portions of said side weirs that are disposed along the peripheral surfaces of said cooling rolls;

said ferromagnetic substance comprises U-shaped members open toward the end surfaces of said cooling rolls and surrounding the first ones of said electric conductors;

said ferromagnetic substance further comprises L-shaped members open toward the peripheral surfaces of said cooling rolls and toward said molten metal contact surfaces of said side weirs and surrounding the second ones of said electric conductors;

the first and second ones of said electric conductors being arranged such that current will flow therethrough in one direction, and the first and second ones of said electric conductors having further electric conductors of said electric conductors disposed at an opposite side of said ferromagnetic substance therefrom, said further electric conductors being arranged such that current will flow therethrough in a direction opposite to the one direction.

16. The device of claim 9, wherein a layered heat resistant material is disposed between said electric conductors and a space between said weirs used to receive molten metal.

17. A continuous casting device, comprising:

a pair of cooling rolls adapted to rotate, said cooling rolls having end surfaces and peripheral surfaces;

side weirs positioned at said end surfaces of said cooling rolls, said side weirs defining a molten metal casting space together with said cooling rolls for receiving poured molten metal and continuously manufacturing a cast piece;

an electric conductor forming a V-shape as a whole along the peripheral surfaces of said cooling rolls on each of said side weirs for electromagnetic sealing along junctions between said side weirs and said cooling rolls by exerting a magnetic flux on the molten metal during casting, said electric conductor being connected to an a.c. power supply;

wherein said electric conductor forming the V-shape has a right side and a left side of the V-shape, and wherein the right and left sides of the V-shape of said electric conductor, at positions facing said molten metal casting space, are arranged to have current flowing in the same direction.

18. The device of claim 17, wherein the right and left sides of the V-shape of said electric conductor, being arranged to have current flowing in the same direction, are positioned at portions of said side weirs at least closest to said cooling rolls.

19. The device of claim 18, wherein said electric conductors of said side weirs are connected together in parallel with a single a.c. power supply.

20. The device of claim 17, wherein said electric conductors of said side weirs are connected together in parallel with a single a.c. power supply.

* * * * *